United States Patent [19]

Klavan et al.

[11] 4,202,913

[45] May 13, 1980

[54] METHOD FOR LIQUID DEVELOPMENT OF LATENT ELECTROSTATIC IMAGES

[75] Inventors: Irving L. Klavan, Teaneck; Peter J. Calabrese, Maywood; Theron R. Finch, Northvale; Arthur Greenberg, all of Teaneck, N.J.; Robert P. McElroy, Spring Valley, N.Y.

[73] Assignee: Philip A. Hunt Chemical Corp., Palisades Park, N.J.

[21] Appl. No.: 916,042

[22] Filed: Jun. 20, 1978

Related U.S. Application Data

[63] Continuation-in-part of Ser. No. 676,463, Apr. 13, 1976, abandoned.

[51] Int. Cl.[2] ..... G03G 13/10

[52] U.S. Cl. ..... 430/106; 101/DIG. 13; 118/661; 430/117

[58] Field of Search ..... 427/15, 17; 118/661; 355/10; 96/1 LY; 346/153; 101/DIG. 13

[56] References Cited

U.S. PATENT DOCUMENTS

| | | | |
|---|---|---|---|
| 3,084,043 | 4/1963 | Gundlach | 96/1 LY |
| 3,335,026 | 8/1967 | De Geest et al. | 427/13 |
| 3,560,204 | 2/1971 | Damm | 252/62.1 L |
| 3,817,748 | 6/1974 | Whittaker | 96/1 LY |
| 3,973,955 | 8/1976 | Ohno et al. | 96/1 LY |

*Primary Examiner*—Ronald H. Smith
*Assistant Examiner*—Stuart D. Frenkel
*Attorney, Agent, or Firm*—Kirschstein, Kirschstein, Ottinger & Cobrin

[57] ABSTRACT

A method for developing a latent electrostatic image by passing the image close to but out of contact with a surface of a liquid developer at a development zone. The values of the magnitude of the charge of the image, the distance between the image segment and the liquid surface at the development zone, and the physical characteristics of the liquid are such that at the development zone the electrostatic field created by the segment of the image at the zone, with or without the assistance of an external electrostatic field impressed upon the development zone, raises pseudopods from the liquid developer surface which extend toward the carrier on which the electrostatic image is present. The pseudopods and/or droplets separated from the tips of the pseudopods leave the liquid surface under the influence of the electrostatic field created by the image segment. Where there is no latent image, the voltage, the gap and the physical characteristics of the developing liquid are such that no developing liquid reaches the carrier, so that these uncharged segments of the carrier are not touched by the tips of the spikes or the droplets and, hence, remain dry and not colored by the color of the liquid if the liquid is colored. These dry spots constitute the background against which the developed latent image is seen. Such background, due to the balancing of the factors mentioned, remains in its virgin state and provides an excellent contrast for the colored developed image.

34 Claims, 18 Drawing Figures

FIG. 1
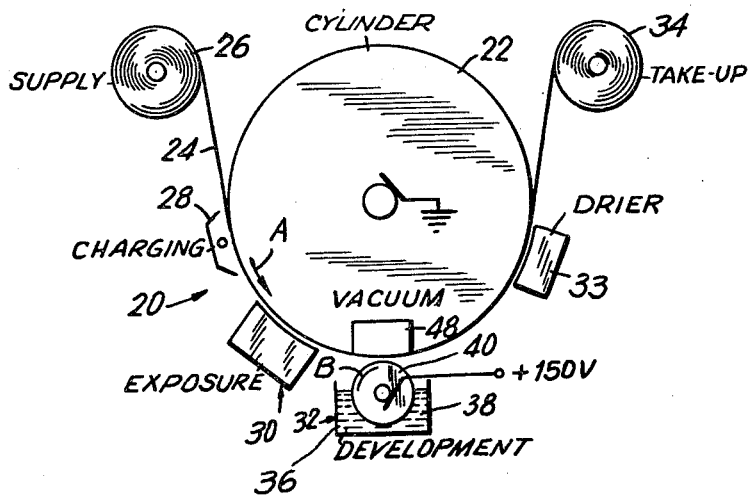
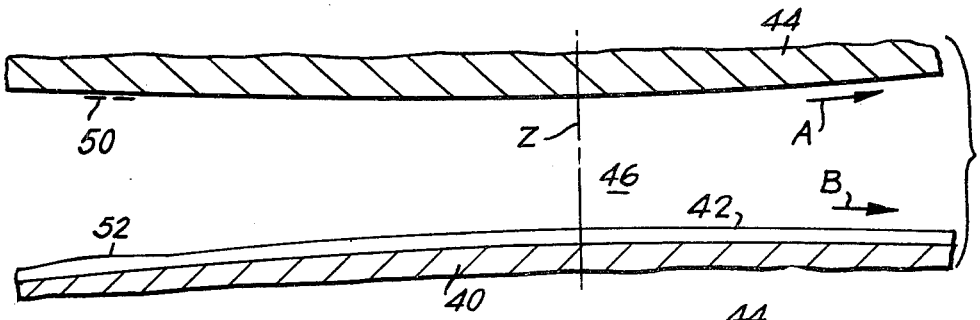
FIG. 2
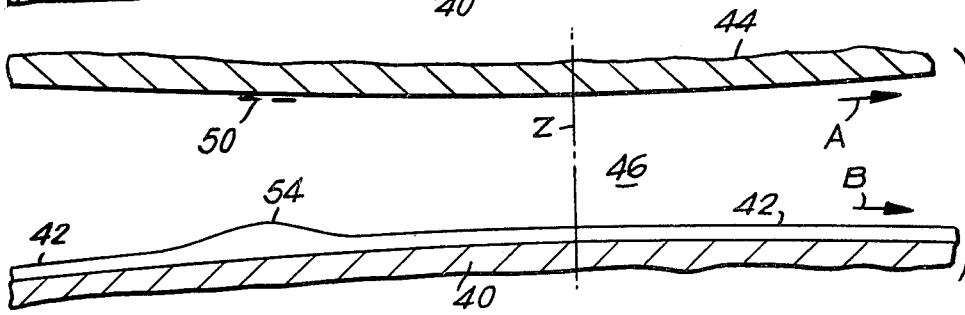
FIG. 3
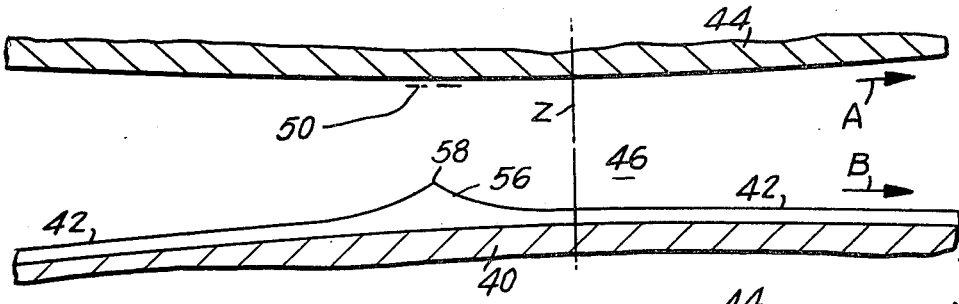
FIG. 4
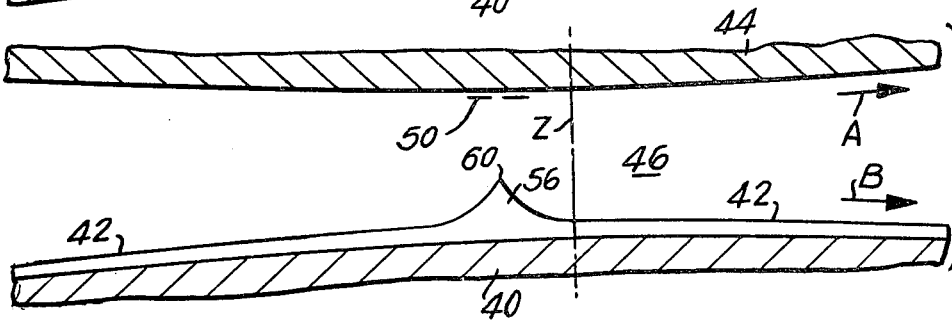
FIG. 5

FIG. 11
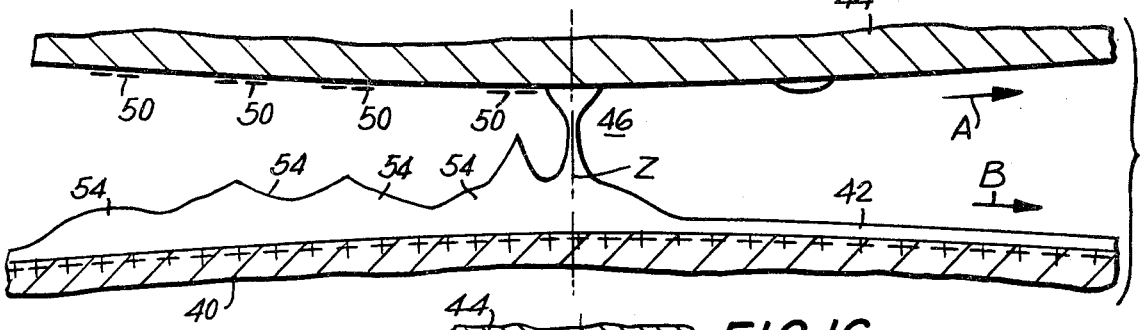
FIG. 16
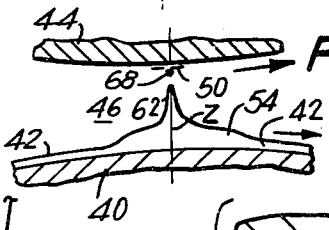
FIG. 13
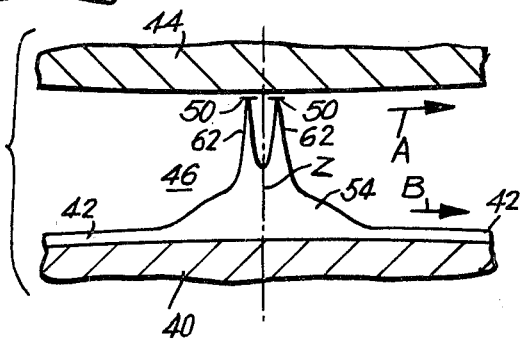
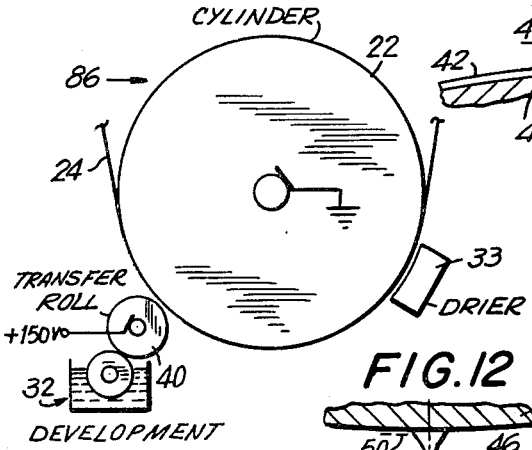
FIG. 18
FIG. 12
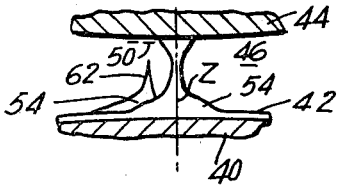
FIG. 14
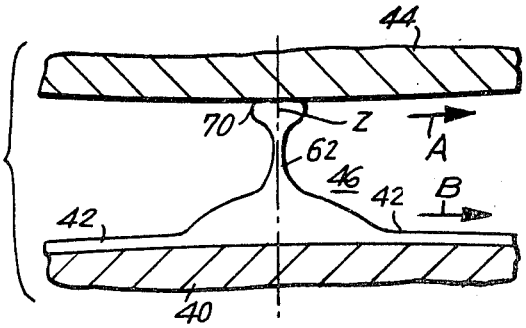
FIG. 17
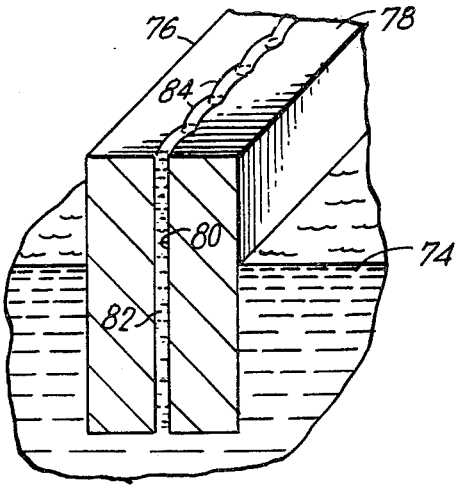
FIG. 15
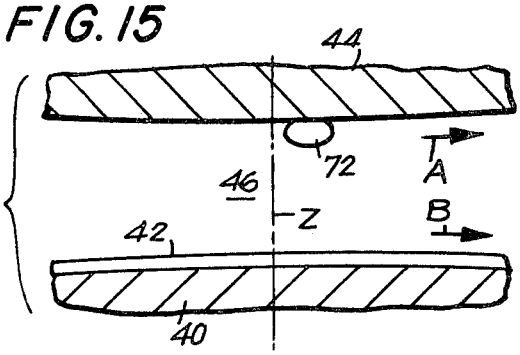

METHOD FOR LIQUID DEVELOPMENT OF LATENT ELECTROSTATIC IMAGES

CROSS-REFERENCE TO RELATED APPLICATION

This application is a continuation-in-part of application Ser. No. 676,463 for Method and Apparatus for Liquid Development of Latent Electrostatic Images, filed Apr. 13, 1976, now abandoned, by Irving L. Klavan, Peter J. Calabrese, Theron Richard Finch, Arthur Greenberg and Robert P. McElroy, and is a companion application to application Ser. No. 916,041, filed June 29, 1978, for Apparatus for Liquid Development of Latent Electrostatic Images by the same inventors.

BACKGROUND OF THE INVENTION

1. Field of the Invention

Liquid development of latent electrostatic images.

2. Description of the Prior Art

In the art of development of latent electrostatic images to which the present invention pertains, the first step is to form on a carrier a latent electrostatic image which consists of many electrostatic segments in various configurations such, for instance, as lines forming characters, letters, symbols, etc., or an object or a picture, the electrostatic segments being juxtaposed to uncharged segments of the carrier. The charged segments can be created in various fashions such, for example, as providing a carrier with a photoconductor insulating layer, imposing an electrostatic charge on the layer, and subsequently discharging the electrostatic charge on segments of the layer by exposure of the layer to a modulated beam of radiant energy, leaving an electrostatically charged latent image. Various other methods can be employed to form a latent electrostatic image such, for example, as providing a carrier which is a dielectric sheet and transferring a preformed electrostatic charge to this sheet.

The current most widely used system for developing a latent electrostatic image, particularly for so-called "office copier" machines, is that in which a developer is cascaded across the latent image. The developer is a dry developer and constitutes a powder which coats carrier particles and is adhered thereto by electrostatic forces that usually are generated triboelectrically. The powder is preferentially attracted from the carrier particles to the latent image, thereby leaving powder on the latent image but not on the uncharged segments. The powder includes a thermoplastic material in the most widely used office copiers. The latent image is carried by a photoconductor surface other than the ultimate copy sheet such, for instance, as a selenium drum, and the powder, in the configuration of the ultimate image, is transferred from the drum to the copy sheet to which it is made to adhere by the application of heat sufficient to fuse the powder to the sheet but insufficient to discolor the sheet.

It also has been proposed to use a flexible copy sheet coated with a photoconductor insulating layer as the carrier for the electrostatic image and to fuse the powder directly to such a sheet.

It further has been proposed to develop a latent electrostatic image by the use of a powder cloud, the developer powder being suspended in a gas which is blown against the latent image and selectively will deposit on the image largely to the exclusion of deposit on the uncharged segments.

All the foregoing techniques are subject to various mechanical drawbacks such as intricate cascading equipment, intricate recirculating equipment for the toner to capture the toner which cascades off the photoconductor insulating layer and bring it back to a zone at which the cascading takes place, and intricate fusing equipment. The powder cloud developing method never has reached the point of widespread commercial acceptance. A further problem with the dry developers was that the powder coating on the carrier particles frequently became dislodged during the cascading across the latent electrostatic image and adhered, for various reasons, to uncharged portions of the carrier, thus forming distracting deposits in the background where no such deposits should be present.

An alternate type of development which basically distinguishes from the dry development above described also has come into vogue, although not to the extent of dry development. This is the so-called "liquid" developing machine. Liquid developing machines have been of various types. That most frequently used is one in which the electrostatic image is formed on a flexible carrier sheet having a photoconductor insulating coating such, for example, as zinc oxide in a carrier such as polyvinyl acetate. The sheet with the latent image thereon then has applied to the image-carrying surface thereof a liquid developer which has most commonly constituted an organic liquid of a high resistivity, as well as dispersed coloring developer particles. Where the liquid is in contact with the image, it conventionally has been in contact with all or substantial portions of the image. The colored developer particles dispersed in the liquid are electrostatically attracted to the sundry image segments of the latent image on the carrier traveling through the liquid and mass at the charged image segments where they remain after the carrier leaves the body of the liquid. The particles may be thermoplastic and fixed to the carrier by the application of sufficient heat to fuse the particles without damaging the carrier. Surface adsorption and/or penetration may be factors in fixing the particles to the carrier in image form. The organic liquid evaporates to leave a dry developed image.

The equipment for a liquid developer machine is considerably simpler than that for a dry developer machine, but the liquid developer machine has many drawbacks such as the loss of the organic liquid, the necessity for ventilating the room in which the equipment is located in order to prevent an objectionable concentration of the vapor of the organic liquid, and the tendency of the uncharged segments of the image to attract some of the developer particles which results in a discoloration of the background and a loss of contrast as well as a loss of edge definition of the developed image.

Other problems with such liquid developing equipment are the creation, on occasion, of a trailing deposit of the particles beyond the edges of the developed image segments in the direction of travel of the carrier through the equipment, an inability to deposit enough particles from the liquid where a charged segment is of substantial dimension, for example, exceeding 1/4" in any direction, and the susceptibility of the image to smudging due, in part, to incomplete setting of the image because of residual retention of the organic liquid.

Another drawback of the liquid developing equipment was economic, and constituted the rather high cost of preparing a liquid developer. The particle size had to be extremely small, the dispersion of the particles in the organic liquid had to be substantially uniform, the particles had to be prevented from settling either upon standing in the machine between uses and over weekends or on the shelf in a storehouse or at a distributor's, or even on the consumer's premises. The drawback of settling of the particles has been overcome by some manufacturers by the inclusion of dispersion agents, and by other manufacturers by special formulation of the solid contents of the liquid developer which made the coloring agents part of an amphipathic molecule of which another part was soluble in the organic liquid. None of these improvements substantially reduced the cost of liquid developers.

It has been proposed to reduce the expense of providing a liquid developer by using water as a carrier in place of the organic liquid. This, also, of course, reduces the problem of accumulation of vapors of the organic liquid in the vicinity of the office copier. It also reduces the cost of the liquid developer. The liquids proposed, generally, have been water containing a water-soluble dye. Due to the employment of the dye as the coloring agent, the problem of settling and dispersion was eliminated. However, to date, there have not been proposed any liquid developing systems employing an aqueous carrier which systems have been commercially accepted. The principal problem with these systems has been that of deposition of some of the liquid developer on the uncharged portion of the photoconductor, with consequent loss of a clean background.

Many such systems have been suggested. One was that disclosed in U.S.L.P. 3,084,043 in which a liquid developer was provided in the valleys of a surface, e.g. a roller surface including lands. The lands contacted or sometimes were very slightly spaced from the surface of the photoconductor and, due to electrostatic force created by the segments of the electrostatic latent image, crept up the sides of the valleys to contact such segments and, theoretically, did not creep up the sides of the valleys in segments where no charge existed. This system was proposed for both polar and non-polar developer liquids.

In another system using a liquid developer, it was proposed to have a developer roller turn in a tank of developing liquid and to provide an electrostatic field in a gap between the developer roller and the latent-image-bearing photoconductor surface. This force raised a swell, something like a standing wave, of developer, to fill the space between the roller and the photoconductor surface, the image being developed essentially by the same principal as that employed to develop a latent image using a liquid developer in which all or successive portions of the latent image were treated with the developer, i.e. both charged and uncharged segments.

Another method proposed was that disclosed in patents such as U.S. Pat. No. 3,383,209 wherein valleys of a developer roller were partly filled with a developing liquid while the lands of the roller engaged the photoconductor surface bearing the latent image. The theory of this system was that the developing liquid had a surface tension such as to render the liquid normally lyophobic with respect to the latent-image-carrying surface of the photoconductor, with the strength of the electrostatic field created by the segments of the latent image being sufficient to result in wetting with the developer of the portions of the surface having latent image segments thereon.

Still another liquid developing system was proposed in U.S. Pat. No. 3,560,204 in which a developer roller turned in a tray containing a liquid developer, the surface of the roller passing beneath a photoconductor web having a latent electrostatic image thereon. The latent image consisted of charged segments juxtaposed to uncharged segments. The spacing, between the film of developing liquid pulled out of the tray by the roller as it turned and the uncharged segments of the image-bearing photoconductor surface, was quite small, not exceeding 3.2 mils. A bias charge was applied to the developer roller that sufficed to draw up unsupported columns of liquid developer purportedly in the shape of the uncharged segments to form ink images on the photoconductor surface. These columns were said to rupture as the photoconductor surface and the film of liquid developer diverged when the roller turned away from its zone of closest proximity to the photoconductor surface.

The processes of all the prior liquid developer systems have been found to leave marks on the background areas where no coloration, theoretically, should exist, and apparently it is for that reason that these processes have not found wide commercial favor despite the many sophisticated modifications which have been proposed.

It will be appreciated that, in general, the common drawback of the various approaches to developing a latent electrostatic image with a liquid developer is the inability to maintain a virgin and, therefore, unmarked background segment where no color is supposed to exist.

Another liquid developer of the type in which the photoconductor surface bearing a latent image is exposed in its entirety or in part to a liquid is illustrated in U.S. Pat. No. 3.068,115 wherein droplets of a developing liquid are formed and drawn through a dielectric liquid in which the developer droplet is immiscible to said photoconductor which is submerged in the dielectric liquid, the droplets being attracted to the charged segments of the photoconductor. This arrangement, obviously, is unsuitable for commercial purposes since it is bulky, unwieldy, slow, requires different liquids in the same piece of equipment, and requires subsequent drying of the photoconductor.

The foregoing summarizes the main systems known to the inventors, it being appreciated that there are a large number of variants of these systems as well as other systems which are in no way relevant to the present invention.

SUMMARY OF THE INVENTION

1. Purposes of the Invention

It is a principal object of the present invention to provide a system for developing latent electrostatic images with a liquid developer in such a manner as to obtain a virtually clean and developer-untouched background.

It is another object of the invention to provide a system of the character described which is capable of employing inexpensive liquid developers.

It is another object of the invention to provide a system of the character described which is capable of employing aqueous developers.

It is another object of the invention to provide a system of the character described which can employ as the liquid developer virtually any kind of colored liquid so that liquids currently available on the market and employed for other purposes such, for instance, as inks and paints, readily can be utilized, even without modification, if desired.

It is another object of the invention to provide a system of the character described which is capable of being effected by the utilization of a very simple method and very simple machinery.

It is another object of the invention to provide a system of the character described for which the toner can be particularly inexpensive.

It is another object of the invention to provide a system of the character described in which the copy can be made as contrasty as desired and of any color that the user wishes.

It is another object of the invention to provide a system of the character described in which the copy is not smeary or smudgy, does not offset, has no tendency toward trailing, and has a clean edge definition and good fill.

It is another object of the invention to provide a system of the character described in which the copy can be made as quick-setting as desired and which does not require extensive drying of the liquid in the developer inasmuch as the copy has far less of the liquid developer applied to it than in a conventional liquid copier.

It is another object of the invention to provide a system of the character described in which the liquid component of the liquid developer can either be polar or non-polar, aqueous or non-aqueous.

It is another object of the invention to provide a system of the character described which can employ any type of surface carrying a latent charge image and which is capable of using the sophisticated variations heretofore proposed for liquid developing systems concerning the setting of a developed image on an original latent charge image carryihg surface of the transfer of such developed image from such a surface to a paper-type surface.

It is another object of the invention to provide a system of the character described which is not based on the system of selective wetting, or on a system of passing a surface with a latent electrostatic image thereon through a liquid bath or held in contact, even momentarily, with a developing liquid.

Other objects of the invention in part will be obvious and in part will be pointed out hereinafter.

2. Brief Description of the Invention

The system of the present invention relates solely to the development of a latent electrostatic image on a carrier, not being concerned with the manner in which such a latent image is created. The latent image can either be a positive or a negative image, which is to say, the latent image may constitute electrostatic charged areas juxtaposed to uncharged areas in which the charged areas constitute the image which is to be developed by depositing a colored liquid thereon, or the latent image may be the uncharged areas which are to be developed with a liquid developer while the charged areas remain uncolored. The latent electrostatic charge images may be of either sign of charge. The carrier can be liquid repellent or liquid wettable, typical carriers being zinc oxide in a polyvinyl acetate matrix, this being the most widely used present-day commercial photoconductively coated sheets, selenium, polyvinyl carbozole which is a polymeric photoconductor, or a dielectric sheet not coated with a photoconductor and on which a latent electrostatic image can be formed by any of the means well known in the art. For example, a dielectric sheet may be a sheet of polyvinyl acetate or of aluminized Mylar. The carrier may be flexible as when it is in the form of a sheet, or it may be rigid as when it is in the form of a drum.

The liquid developer is in the form of a body thereof having a surface located at a specific site. A preferred method for effecting this arrangement is the provision of a liquid developer in a tray or tank with a cylindrical developer roller turning about a horizontal axis and having a portion submerged in the tank, the roller being rotated by a power drive so that portions thereof successively are submerged under the surface of the liquid developer in the tray and thereafter are raised above the same and toward the carrier on which the latent electrostatic image is disposed. Liquid developer is carried up on the surface of the roller in the form of a thin film thereon the thickness of which depends upon various parameters, principally the viscosity and surface tension of the liquid developer and the surface speed of the roller. Thus, the liquid developer which is pulled up out of the body of the developer in the tray tends to maintain a substantially uniform thickness and to be relatively quiescent with respect to the roller, except for the electrostatically generated disturbances hereinafter described. The roller may be textured to maintain a film as liquid leaves the body of the developer and to provide additional liquid below the surface of the film that can be used in the developing process now to be described. The texturing is of any form known to the art, e.g. annular grooves, a helical groove, or a pattern of valleys.

The developer roller is spaced from the surface of the photoconductor at a development zone, the relative positions of these two elements being such that the surface of the liquid developer film invariably is no higher than the photoconductor surface at the zone. In a preferred form of the invention a developer roller is used and the photoconductor surface moves past and over this roller, itself being either held against a superior roller or traveling in a horizontal path supported by a stationary platen above the developer roller. In such a construction the carrier with the photoconductor layer is most conveniently vertically above the highest point of the developer roller for a reason which soon will be apparent. However, any relative arrangement of these two components will produce satisfactory results so long as the portion of the developer roller which is closest to the photoconductor surface never is above said surface. For example, the system will function where the developer roller is, at its zone of closest approach to the photoconductor surface, spaced therefrom in a horizontal direction. In general, the system works better as the spacing at the development zone where the developer roller is closest to the photoconductor surface approaches the vertical.

It is a critical feature of the present invention that a certain range of spacing be provided in the system between the photoconductor surface and the surface of the liquid at the development zone, and that this spacing not exceed a certain distance. The minimum spacing is 4.5 mils. The maximum spacing is 40 mils. Where the spacing is less than 4.5 mils, the background is not kept clean, as it is from 4.5 mils upwards. Beyond 40 mils, acceptable development will not take place. A preferred upper limit is 20 mils.

In a preferred form of the invention, the thickness of the developer liquid on the developer roller is about 1.5 mils, and the spacing from the surface of the liquid developer film on the developer roller to the photoconductor surface is about 7.5 mils.

It has been found that development is aided by the presence, which is not absolutely essential, of an externally applied electrostatic field at the development zone which functions satisfactorily where the direction of the applied field is the same as that of the field caused by the latent electrostatic image. The direction of the externally applied electrostatic field depends upon whether the image to be developed is a negative or a positive image, and depends upon whether the charge polarity of the image is positive or negative. Typical voltages for creating the externally applied electrostatic field vary from about −1,000 volts to about +1,000 volts, preferred values being considerably less, and excellent results being obtained at a voltage of about 150 volts. Where the gap spacing afore-mentioned, which is the spacing between the surface of the film of liquid developer and the photoconductor surface, increases, it is desirable to increase the voltage, a typical voltage at a spacing of 15 mils being about 300 volts. It has been found, in general, that better images are secured with a smaller spacing than 15 mils but, of course, still not smaller than 4.5 mils, and a voltage not in excess of 200 volts. As just mentioned, the best results have been obtained with a gap spacing of 7.5 mils and a voltage of 150 volts, the charged image being about 450 volts.

The reason that the minimum spacing above mentioned is critical to the operation of this invention arises from the manner of operation of the present system which prevents the formation of background at the development zone, such background being characteristic of all the previous electrostatic liquid developer systems. What occurs in the operation of the present invention is that the surface of the liquid developer and the photoconductor surface first relatively approach each other at the development zone and then diverge from each other, the spacing at the point of closest approach, this being the development zone, never being less than 4.5 mils nor in excess of 40 mils. During the approach period, as the spacing between the two surfaces gradually reduces, a series of transformations takes place progressively in the film of developer liquid closest to a given segment of the latent electrostatic image. The initial transformation is the raising of a low mound in the film which mound, in a circumferential cross-section, is roughly symmetrical about the circumferential center of the mound, the latter being approximately in vertical registration with the given segment. The symmetry is most pronounced where the surface of the developing liquid vertically below the segment is located on a cylindrical roller. The mound presents an outwardly convex shape. The mound increases in height as the mound and segment approach closer to each other and closer to the development zone. At a certain point, depending upon the amplitude of the charge in the segment, the viscosity of the liquid developer, the surface tension of the liquid developer, the strength of the field engendered by the electrostatic charge image, the amplitude of the gap spacing, the thickness of the developer film, the uniformity of the gap, and the absolute and relative speeds of the liquid developer film and the photoconductor surface, first a slight proturberance appears at approximately the apex of the mound, and the proturberance then rapidly elongates, almost as a jet, into a pseudopod which is a slender long liquid spike protruding from the center of the mound toward said segment. The specific cross-section of the spike will approximate the specific configuration of the segment, i.e. if the segment is a dot such as in a half-tone image, the pseudopod will be approximately circular in cross-section; whereas, if the segment is a line running parallel to the longitudinal axis of the developer roller, the pseudopod, in addition to being elongated toward the segment, will be elongated in a configuration matching the segment. If there are several charged areas in the segment spaced from one another in the direction of axis of rotation of the developer roller, there will be several such mounds and, subsequently, pseudopods formed along a line parallel to said axis.

It is pointed out that the formation of the pseudopods under the influence of the electrostatic field created by the segment, optionally assisted by the external field, the total field tending to form the mound and then the pseudopod and then elongate and slenderize the pseudopod and particularly the tip thereof, acts against gravity and against the surface tension of the liquid. However, the electrostatic force is sufficient to raise the mound and pseudopod as just described so that the tip thereof approaches proximity to the segment.

At the development zone where the roller surface and the photoconductor surface are closest to each other, either one of two events transpires, depending upon the dimension of the gap, the amplitudes of the various potentials, and the physical characteristics of the liquid developer. The first event is that the tip of the pseudopod touches the photoconductor surface, and immediately thereafter the pseudopod collapses due both to the discharge of the charge from said segment and the elongation of the pseudopod as the two surfaces diverge from each other, leaving a droplet of the developer liquid, which formerly was the tip of the pseudopod, on the photoconductor surface.

The other event is that as the pseudopod is attracted to the segment, a point ultimately is reached where the tip of the pseudopod is detached from the pseudopod to form a droplet which, under the electrostatic force still existing because the segment still is charged, travels to the segment to impinge on the photoconductor surface thereat.

In either event, a minute amount of the developer liquid is deposited on the photoconductor surface, this constituting a development of said segment of the latent image. The droplet may either be drawn into the surface if the same is bibulous, or slightly spread on the surface if the surface is not highly bibulous but is wettable by the liquid employed, or it may simply maintain its form as a droplet if the surface is nonwettable by the liquid employed, existing as a small bead until it dries. If the spike is elongated parallel to the axis of rotation of the roller, the droplet likewise will be elongated in the same direction. The specific configuration of the spike and the number of spikes that exist on any mound or group of mounds largely will depend upon the configurations of the charged segments. For example, if there is a solid area to be developed, a large number of spikes closely spaced to one another will be formed which will provide a large number of droplets on the photoconductor surface, which droplets will merge into one another.

The critical spacing aforementioned creates a nice balance between the force of electrostatic attraction that forms a pseudopod and/or droplet and the counteracting forces of gravity and surface tension, which is what brings about the lack of deposit of developing liquid on the uncharged juxtaposed portions of the segment. Where there is no charge on the segment, this being the background for the image in the example being described, the forces of gravity and surface tension combine to prevent the tip of the pseudopod from ever reaching the photoconductor surface, and further prevent either the formation of a droplet which is detached from the tip of the pseudopod or the travel of a droplet, if formed, far enough to reach the photoconductor surface. Hence, the background remains as the virgin surface of the photoconductor and is unusually clean pursuant to the practice of the present invention.

Although in the foregoing description the developer liquid has been described as being brought to the developing zone in the form of a film on the rotating developer roller, other arrangements can be provided which will secure equivalent results. For example, the developer liquid in a tray may be raised to the desired proximity to the photoconductor surface at the developing zone by capillary means such as a sieve with capillary openings, or a wick, or two or more closely spaced plates forming capillary spaces the lower ends of which are in contact with the developer liquid and the upper ends of which are at the development zone, with the proper spacing between the latent charge image carrying surface and the surface of the developer liquid which wells out of the upper ends of said capillary spaces.

It also should be pointed out that the specific development just described is for development of positively or negatively charged areas of a latent image.

The invention consists in the series of steps which will be exemplified in the methods hereinafter described and of which the scope of application will be indicated in the appended claims.

BRIEF DESCRIPTION OF THE DRAWINGS

In the accompanying drawings in which are shown various possible embodiments of the invention:

FIG. 1 is a schematic diagram of a preferred apparatus for carrying out the present invention;

FIGS. 2–9 are highly enlarged views of the development zone of the apparatus of FIG. 1, showing progressive stages leading to the following pseudopod development of a single charged area of electrostatic latent image on a photoconductor surface;

FIG. 11 is a view similar to FIG. 8, but illustrating plural, widely spaced charged areas of an electrostatic latent image on the photoconductor surface and also illustrating a voltage on the developer roller;

FIG. 12 is a view similar to FIG. 8, but illustrating in the background a second pseudopod for a charged area of an electrostatic latent image on the photoconductor surface which is about to be developed;

FIG. 13 is a view similar to FIG. 7, but showing twin pseudopods associated with two discrete charged areas of an electrostatic latent image on the photoconductor surface;

FIG. 14 is a view similar to FIG. 8, but showing a non-wetting surface on the photoconductor surface in contrast to the wetting photoconductor surface of FIG. 8;

FIG. 15 is a view similar to FIG. 9, but illustrating a deposited droplet on the photoconductor surface which latter is of a non-wettable nature as distinguished from the wettable nature of the photoconductor surface in FIG. 9;

FIG. 16 is a view similar to FIG. 8, but showing the detachment of a droplet from the pseudopod at a stage when the droplet has become detached from the tip of the pseudopod and is moving toward but has not yet reached the photoconductor surface, the same differing from FIG. 8 in that in FIG. 8 the tip of the pseudopod has touched the photoconductor surface, whereas in FIG. 16 the tip of the pseudopod does not reach the photoconductor surface but, rather, has the droplet detached therefrom which flies to the photoconductor surface;

FIG. 17 is a perspective view of an apparatus embodying an alternate form of the invention in which at the development zone the liquid developer is raised by a capillary passageway that leads from a body of liquid developer to a region spaced from and below a photoconductor surface, the latter not being shown in said figure; and FIG. 18 is a view similar to FIG. 1 of another embodiment of the invention in which the developer roller is angularly spaced from the bottom of the platen on which the photoconductor web is trained.

DESCRIPTION OF THE PREFERRED EMBODIMENTS

Figure 6:
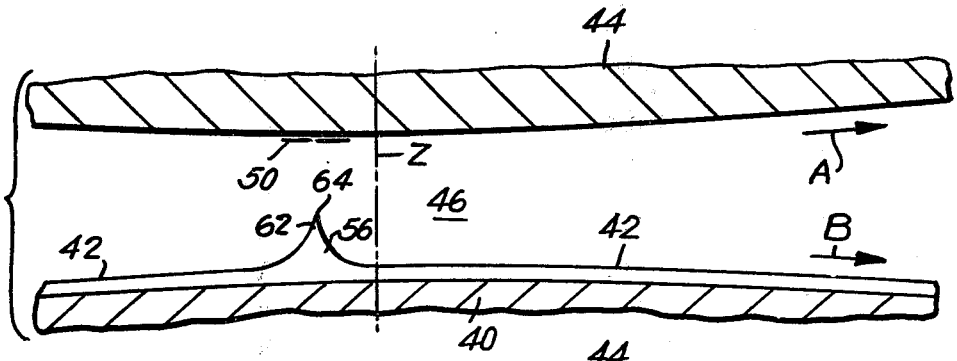

Referring now in detail to the drawings, and more particularly to FIGS. 1–9, the reference numeral 20 denotes a preferred embodiment of the apparatus for carrying out the instant invention. In all respects, except development, the apparatus is conventional. The apparatus includes a back-up platen 22 of cylindrical configuration and suitable means to rotate the same. This means is not illustrated, being conventional. The sole function of the back-up platen is to guide the path of travel of a web 24 from a supply roll 26 past a charging station 28, an exposure station 30, and a development station 32, a drying station 33, in turn, to a take-up roll 34.

The charging station is entirely conventional. It usually will constitute a corona charging station. The exposure station 30 likewise is conventional and includes, as is well known, a source of radiant energy which projects a beam of radiant energy either through a transparency to be reproduced, or reflects such a beam off an opaque carrier on which there is provided an image to be reproduced, the beam of radiant energy thereby being modulated by the image to be reproduced. The modulated beam then is directed momentarily onto the charged web 24, forming a latent electrostatic image thereon in a manner with which the art is thoroughly familiar. The web at the development station has the latent image developed at a development zone Z. The development station includes a tray 36 containing a body of liquid developer 38. A developer roller 40 having a horizontal axis of rotation parallel to that of the platen is turned by a suitable power source (not shown), the roller being so located that the lower side thereof is submerged in the liquid developer whereby the turning roller pulls up from the tray 36 a film 42 of liquid developer on the roller surface to and then past the development zone Z.

The web 24 is of conventional construction. It includes a carrier, e.g. paper, having on one surface a photoconductor coating 44. This coating faces away from the platen 22. Since in the apparatus 20 the developer roller 40 is vertically below the axis of rotation of the platen, the photoconductor surface faces downwardly toward the developer roller at the development zone Z.

At the charging station a positive electrostatic charge potential is formed on the photoconductor coating which is present on the surface of said coating, the charge being uniform over the coating between the charging station and the exposure station.

At the exposure station the impingement of the modulated beam of radiant energy causes a discharge of the electrostatic charge on the surface of the photoconductor in those segments where radiant energy strikes the photoconductor surface. The balance of the electrostatic charge remains in the form of a latent electrostatic image not visible to the eye. This is the image which is to be developed at the development station 32.

It is well to mention at this point that a typical photoconductor constitutes a coating on a carrier, e.g. a paper carrier having a conductive rear surface, the coating being, for example, zinc oxide in a matrix of polyvinyl acetate. Such a photoconductor on a carrier is widely used in office copying machines at the present time and is a standard item of commerce. The photoconductor surface, instead of being part of a continuous web 24 as illustrated, may constitute a series of pre-cut sheets, in which event, the sheets may be guided and driven on a stationary curved platen surface past the charging, exposure and development station, in turn, or may pass over a flat platen as it moves from the first of these stations to and past the succeeding ones.

It also is to be understood that FIG. 1 simply is representative of one of the many types of standard office copier apparatuses, any of which can be substituted for the one illustrated, wherein the only novelty resides in the development station, this having been described in general terms heretofore.

It also should be pointed out that when a continuous web is employed, as shown, and leaves the apparatus to be stored on a take-up roll, subsequently the web, with developed images, will be drawn off the take-up roll and subdivided into sheets each including one or more of the developed images. If desired, the take-up roll can be omitted and a standard cutting mechanism utilized to cut one sheet at a time from the terminal end of the web after development, each such sheet including usually only a single developed image.

These alternate forms of the apparatus simply have been mentioned in passing so that it will be understood that the instant invention is not to be restricted to any particular form of apparatus, with the sole exception of the novel principle that is employed at the development station.

It further should be mentioned that the specific structure of the development station can be varied and, indeed, an alternate structure has been illustrated in FIG. 17 which will be described subsequently, and an alternate location for the development station 32 has been illustrated in FIG. 18.

Also as mentioned previously, it is critical to the proper functioning of the present invention that the development station not be so located that the space between the developer roller and the photoconductor surface 44 includes a vector component extending upwardly from the photoconductor surface. The only permissible locations of the development station with respect to a photoconductor surface having a latent image thereon to be developed are ones in which there is a downward vector from the photoconductor surface for the space between the photoconductor surface and the surface of the developer roller. The vector preferably is vertically downward, but it may include vectors which have a vertically downward component or vectors with a lateral component solely.

The charging station illustrated likewise is only exemplificative. Various other modes well known to the art can be utilized to impart an electrostatic latent image of any desired configuration to the outwardly facing surface of a carrier. Thus the latent electrostatic image can be emplaced on a dielectric carrier by transference from a previously charged photoconductor surface; or a latent electrostatic image can be emplaced on a dielectric surface by alternate means such as by electrostatically charged pins; or by an electrostatically charged face of a cathode ray tube; or by a scribing implement such as an electrostatically charged stylus which can be used to write on the surface; or by an electrostatically charged element in the configuration of an image of the desired shape; or by a thin beam of electrically charged particles, e.g. electrons, which is directed as with electrostatic yokes to follow a desired path; or by charging with a broad area charging beam through a mask in the desired pattern.

In addition, it is pointed out that the present invention is not restricted to the specific photoconductor hereinafter above mentioned in the description of the preferred embodiment, to wit, zinc oxide in a polyvinyl acetate matrix. For example, the photoconductor surface may be formed of selenium, e.g. in the configuration of a drum which successively passes charging, exposure and development stations and thereafter a transfer station for transferring the developed image, still in liquid form, as will be apparent subsequently, to a copy sheet such as a bond sheet.

Still another form of latent charge image carrier is a dielectric sheet which may have a conductive coating on its reverse side, as, for example, aluminized Mylar, or which may be uncoated. Such sheets have an electrostatic charge in the configuration of a latent image emplaced thereon by any one of the modes heretofore described except that of corona charging and subsequent radiant energy selective discharging.

Summarizing, the development which constitutes the heart of the present invention is a novel method of toning a latent electrostatic image; not the system pursuant to which the latent image is created, nor the use that is made of the toned image. The latent image may be formed in many ways all of which fall under one or the other of two generic classes. In the first class, a substrate is electrically charged over its entire surface and subsequently is selectively discharged according to a predetermined pattern; in the other class a substrate has a patterned electrical charge applied to it without first charging a broad area that subsequently is discharged to leave a pattern.

In the first mentioned class, the mode of broad area charging is not critical. It has no bearing upon the toning step of the instant invention; various methods of charging can be utilized. One is the use of a corona charging device. Another is transfer charging as from a charged platen or a roller. In all of these broad area charging methods the substrate is such that it will hold the broad area charge and can be discharged selectively in the time scale required to tone the image.

The ways in which selective discharge may be effected are many. By way of example, one is to employ a photoconductive substrate such as mentioned above and to discharge the same selectively in a pattern by casting thereon a broad beam of imagewise modulated electromagnetic energy to discharge selected segments of the broad area and leave the remnant desired charge pattern. Such a beam of electromagnetic energy can be a beam of light, or it may be a beam of electromagnetic energy of a different frequency than light, this being, for instance, an imagewise modulated X-ray beam or an imagewise modulated ultraviolet beam. The imagewise modulated broad area beam is cast on the charged surface of the substrate either directly, or by reflection, or by transmission through the substrate from an opposite surface thereof, the substrate in such case being transparent to the energy.

In all of the just mentioned systems, the substrate is characterized by its ability selectively to discharge a charge upon the impingement thereon or therethrough of a beam of electromagnetic energy.

Also embraced within the first class are systems wherein the substrate is not such as to be discharged by the impingement of an imagewise modulated broad area electromagnetic beam, for example, being not photoconductive but simply dielectric. A broad area charged dielectric substrate can be discharged by directing a beam thereon that is imagewise modulated over a broad area and is capable of selectively discharging the broad area charge or neutralizing the same. Such a beam, for example, can be a broad area ion beam.

Equipment for broad area patterned neutralization or discharge of a charged substrate is of sundry types. In one the imagewise modulated beam and charged substrate move in synchronism; in another the imagewise modulated beam is of extremely short duration and high intensity, i.e. a flash.

Furthermore, in the first class, neutralization or discharge of a broad area charged substrate may be accomplished by contacting the broad area charge surface with a narrow element which selectively discharges segments thereof according to a desired pattern. This narrow element can be a mechanical member, for instance, a grounding rod, or it may merely be a narrow beam which can cause the charge to be differentially neutralized or discharged and leave a predetermined charge pattern. For instance, the beam may be a narrow beam of light which is scanned over the broad area and modulated as it is scanned so as to selectively discharge or neutralize successive segments, the scanning being of the raster type.

Instead of employing a light beam, a beam of electromagnetic energy of a frequency different from light frequency can be used, or, if desired, the scanning can be accomplished with a beam of coherent electromagnetic energy such as a laser beam. Such a scanning beam can be controlled, for instance by a computer which modulates the beam as it scans. Devices of their nature can be used to perform what has been commonly referred to as computer printing and are employed, for instance, in composing images suitable for use in the printing of newspapers or, in general, in the graphic arts.

The narrow beam type of neutralizing or discharging a broad area charge can be applied to substrates of the simple dielectric type as well as to substrates which are discharged by the impingement thereon or therethrough of narrow beams of electromagnectic energy.

The other class of creating charge patterns is practiced with a dielectric substrate which is capable of having emplaced thereon a charge that will remain in position long enought to be toned developed and which will retain its integrity over the substrate. Such a substrate has an electrostatic image impressed thereon by virtue of any of the modes mentioned earlier in connection with the emplacement of latent electrostatic images thereon as by transferrence, electrostatically charged pins, electrostatically charged face of a cathode ray tube, etc. These include, by way of summation, the emplacement of an entire charge image at one time or the emplacement of the image by movement of a narrow beam of charged particles across the surface to be pattern charged.

A critical feature of the present invention is the presence of a gap within a specific range of sizes between the photoconductor surface and the surface of the quiescent developer liquid film at the development zone Z. This gap can be seen by close inspection of FIG. 1, but because the scale of that figure prevents a clear illustration of the gap, the development zone and its adjacent region, both before and after said zone, are shown to a highly enlarged scale in FIGS. 2–9. In these figures the photoconductor coating 44 and the developer roller 40 with its film 42 of liquid developer are greatly enlarged, as is the gap 46 at the development zone Z. None of these components is shown strictly to scale, even as to relative sizes. It is not thought that this is necessary since the particular dimensions will be described.

Both the photoconductor coating 44 and the developer roller 40 of which portions are shown in FIGS. 2–9, are circular. Both of these may be of the same radius. However, as illustrated in FIG. 1, the platen 22 and, hence, the photoconductor coating 44 have greater radii than the developer roller 40. Nevertheless, for convenience, in FIGS. 2–9 the photoconductor coating 44, the developer roller 40 and the film 42 of liquid developer have been illustrated as having substantially the same radii.

As illustrated in FIGS. 1–9, the platen 22 turns in a counterclockwise direction indicated by the arrow A, and the developer roller 40 turns in a clockwise direction as indicated by the arrow B, so that at the development zone Z both the platen and developer roller have surfaces traveling in substantially the same direction. Actually, the direction is not identical except precisely at the development zone, inasmuch as the directions of travel A and B are circular rather than linear, so that as the photoconductor coating 44 and the film 42 of liquid developer approach the development zone Z they come closer to each other, and as they leave the development zone Z they diverge from each other.

Save for the electrostatically engendered disturbances in the film 42 at the development station, said film, as it is pulled up from the tray 38, maintains a substantially constant thickness. The range of thicknesses of the film 42 of liquid developer may vary from about ½ mil to about 10 mils, and preferably is about 1.5 mils. The lower end of said range, including the 1.5 mils, prevails for watery type, i.e. thin, liquid developers, whereas the upper end of the range prevails for more viscous developers.

Various examples of developers will be set forth subsequently, but since viscosity has just been mentioned, it is appropriate to state, at this point, that a suitable range of viscosities for the liquid developer is from about 0.5 centipoises to about 50 centipoises. By way of example, a liquid developer predominantly constituting water and including a slight amount of dyes, e.g. about 0.5% by weight of a dye or dyes, has a viscosity of approximately 0.9 centipoises. A liquid toner which employs an organic solvent such, for instance, as Isopar H, and has present therein dissolved resins, dispersants and charging agents, the latter optionally being dispersed, and dispersed pigments, usually has a viscosity in the range of 30 centipoises.

Another suitable liquid developer is a latex paint of the common, everyday variety such as is obtained from paint stores and is used for painting the interior or exterior of a house and which may be a flat paint or an enamel. The viscosity of such a paint is in the order of 38 centipoises. The latex paints may be thixotropic and, if so, their viscosity will vary with the speed of the developer roller, this being a typical characteristic of thixotropic materials. The viscosities of such paints used in conjunction with the practice of this invention have varied with different roller speeds from centipoises between 2.5 and 38.

Indeed, the present invention will function with any liquid within the viscosity range mentioned and within the surface tension range later to be mentioned so long as the liquid will, upon evaporation of the liquid carrier, be it water or any organic liquid, leave a colored residue, whether it be a film or simply a colored material, e.g. impregnated into or deposited on the surface of the photoconductor or the surface of a copy sheet onto which a developed image, while still liquid, has been transferred from the photoconductor to the copy sheet. For example, all of the current commercial liquid developers used in liquid office copier machines can function pursuant to the present invention. The present invention will operate with polar and non-polar liquids, although it is preferred to use water-based liquids because of their very low cost. Indeed, it readily will be appreciated that water-based liquids can be prepared for but a small fraction of the cost of currently commercially used organic-liquid-based developers for office copier equipment.

The surface speed of the photoconductor coating and the liquid film can vary quite widely. Even a speed of 150 feet per minute is well within the scope of the present invention. Preferably, the directions of surface travel of the photoconductor coating and of the film of liquid developer are the same at the development zone Z. The absolute speeds likewise may be the same or they may vary somewhat. Relative speeds of the photoconductor surface and the film of liquid developer at the development zone have been found to be operable pursuant to the present invention where the speeds are identical or where they vary as much as 20 feet per minute from each other. A preferable relative speed is one in which the photconductor coating travels to and past the development zone about one foot per minute faster than does the film of liquid developer. Preferred speeds for the photoconductor coating range from about 20 feet per minute to about 90 feet per minute, and even considerably higher, e.g. 150 feet per minute by way of example, the former providing about 120 copies per minute of standard size photoconductor coated sheets. It is within the ambit of the invention to have the surfaces of the liquid developer film and the photoconductor coating travel in opposite directions, providing that the difference in speeds is not excessive, e.g. not more than about 20 feet per minute at the development zone.

With regard to the critical range of spacing of the gap 46, the smallest gap from the photoconductor surface 44 to the surface of the liquid film 42 in quiescent state of the development zone Z is 4.5 mils. With a lesser spacing, and even with the most favorable values of the sundry variables discussed heretofore and hereinafter, the background segments of the electrostatic latent image where there is not supposed to be any deposit of liquid developer will have deposits of liquid developer thereon to a small or large extent. The background deposits may be enough to render the developed image completely illegible, or merely destroy the clarity of the image as by losing edge definition, or there may be a random distribution of deposits of liquid developer in the supposedly clear areas where no liquid developer should be present and this will increase the coloration of the background so as to lose contrast and present a muddy developed image. At a spacing of 4.5 mils with proper adjustment of all parameters, a commercially acceptable image will be obtained through the use of the present invention. However, it has been found that the best image is obtained at a spacing of about 7.5 mils where an aqueous toner is used, whether of low or high viscosity.

The surface potential of the latent electrostatic image is that which is commonly employed in the art for office copiers, be they of the dry or liquid type. A typical surface potential for the latent electrostatic image is not less than about 100 volts and usually will be in the vicinity of 450 volts, either positive or negative. Such a surface potential is employed for coated paper, i.e. paper coated with zinc oxide in a polyvinyl acetate carrier. A similar order of potential is employed for photoconductor surfaces of selenium, polyvinyl carbazole and cadmium sulfide.

It will be understood that the aforesaid potentials usually are applied by corona charging equipment which leaves a residual electrostatic charge of the mentioned magnitudes; this does not apply to dielectric sheets. A transferred charge or charges applied through instrumentation such as writing beams or writing implements likewise will be of the same orders of magnitude.

Due to the fact that the absolute physical size of the gap 46 is so small, it is desirable to maintain a close control over the same. Obviously, the bearings for the platen and the developer roller are sufficiently heavy and sufficiently well supported and of sufficient precision so that neither of these rollers will vibrate appreciably toward or away from each other. Moreover, both the platen and the roller are of comparatively small lengths, inasmuch as conventional material to be copied seldom exceeds 18" in width. However, to minimize variations in the gap uniformity, it is desirable to make the platen 22 hollow and foraminous and to maintain a vacuum on the inner surface of the platen at the development station, this being accomplished by providing a vacuum box 48 inside the platen at said station. The vacuum will pull the web against the platen at the development station so that it occupies a substantially definite position during development, particularly at the development zone.

The film thickness is maintained substantially constant at quiescent portions of the film, e.g. as it approaches the development zone, by maintaining a uniform speed of rotation of the developer roller, by protecting the development zone, e.g. with baffles, to inhibit moving air currents, and by constructing and supporting the machine to minimize vibration. This latter is not a noticeable factor nor, indeed, are the normal movements of air in the apparatus 20 wherein the various parts are housed in a casing (not shown) as much for the purpose of esthetics as for the purpose of keeping the sundry parts and developing liquid free of foreign particles.

Any ordinary motor and power drive will turn the developer roller and the platen at speeds which are sufficiently constant not to create any untoward variation in the selected gap spacing.

Preferably, the uniformity of the gap spacing is kept within a range of plus or minus about 0.3 mils at the minimum 4.5 mils spacing and, indeed, throughout the entire range of gap spacings. The only factor that appreciably will affect this gap uniformity is any deviation from cylindrical regularity of the platen and of the developer roller. This tolerance is sufficiently large so as not to present any appreciable problem in carrying out the present invention.

A preferable range of surface tensions for the liquid developer is from about 20 to about 75 dynes/cm. The surface tension of water at 20° C., which essentially is the surface tension of dye-containing water developers, is about 72 dynes/cm. Water-based latex paints have a surface tension range of about 37 to 41 dynes/cm. The surface tension of Isopar G, one of the organic solvents widely used in non-polar liquid developers, particularly for submersion development, is 22 dynes/cm.

The density of the liquid developer has but little influence on the gap spacing. Generally speaking, liquids of higher densities will operate satisfactorily at lower gap spacings, all other parameters being about the same, and liquids of lower densities will operate better at greater spacings, all other parameters being the same. Nevertheless, the parameters can be balanced to take into account the density of the liquid employed so that the same gap spacing can be used for liquids of different densities.

As mentioned previously, a preferred gap spacing for an aqueous developer containing a dye is about 7.5 mils. Moreover, the same gap spacing also is preferred for liquid developers such as paints, so that it will be appreciated that the sundry parameters such, for instance, as surface tension, density and viscosity do not have an appreciable influence on gap spacing.

A typical density for a paint-type latex water-base liquid developer is about 1 gram/cc. A typical density for a liquid developer employing an Isopar organic liquid as the liquid carrier is about 0.75 grams/cc.

As mentioned previously, almost any liquid can be used as a liquid developer, these including paints and inks, i.e. water containing a water-soluble dye and/or a water-dispersible pigment, and also conventional liquid developers now employed for liquid developing machines which have a liquid base constituting an organic solvent and including a film former either dissolved or dispersed therein, a charge director either dissolved or dispersed therein, a dispersing agent, and a coloring agent suspended or dissolved in said liquid.

Exemplificative liquid developers are set forth below:

EXAMPLE I

Latex gloss trim enamel, presently commercially available from Benjamin Moore under the trademark Aquatrim The pigment is 5.3% by weight of the enamel, and consists of 47.4% by weight of the pigment of carbon black and 52.6% by weight of the pigment of silicates. The vehicle constitutes 94.7% by weight of the enamel and is an acrylic emulsion of which the non-volatile phase is an acrylic resin in the amount of 29.8% by weight of the vehicle, and the volatile phase is a mixture of water and alcohol making up 70.2% by weight of the vehicle.

EXAMPLE II

Latex gloss enamel, presently commercially available from Red Devil under the description Interior/Exterior Gloss Latex Enamel; it bears the commercial identification LF251 Bold Blue The pigment is 5.6% by weight of the enamel, and consists of titanium dioxide and phthalocyanine blue. The vehicle constitutes 94.4% by weight of the enamel and is an acrylic emulsion of which the non-volatile phase is an acrylic resin, and the volatile phase is a mixture of water and propylene glycol.

EXAMPLE III

Latex gloss enamel, presently commercially available from Red Devil under the description Interior/Exterior Gloss Latex Enamel; it bears the commercial identification LF254 Crimson The pigment is 6.1% by weight of the enamel, and consists of toluidene red in an amount of 1.7% by weight of the enamel, arylide red in an amount of 2.1% by weight of the enamel, and red iron oxide in an amount of 2.3% by weight of the enamel. The vehicle constitutes 93.9% by weight of the enamel and is an acrylic emulsion of which the non-volatile phase is an acrylic resin which is 27.6% by weight of the enamel, and the volatile phase is a mixture of water and propylene glycol which is 66.3% by weight of the enamel.

EXAMPLE IV

Latex gloss enamel, presently commercially available from Red Devil under the description Interior/Exterior Gloss Latex Enamel; it bears the commercial identification LF252 Kelly Green The pigment is 12.1% by weight of the enamel, and consists of titanium dioxide, hansa yellow and phthalocyanine green. The vehicle constitutes 87.9% by weight of the enamel and is an acrylic emulsion of which the non-volatile phase is an acrylic resin and the volatile phase is a mixture of water and propylene glycol.

EXAMPLE V

Latex gloss enamel, presently commercially available from Red Devil under the description Interior/Exterior Gloss Latex Enamel; it bears the commercial identification LF258 Jet Black The pigment is 1.6% by weight of the enamel, and consists of lamp black. The vehicle constitutes 98.4% by weight of the enamel and is an acrylic emulsion of which the non-volatile phase is an acrylic resin, and the volatile phase is a mixture of water and propylene glycol.

EXAMPLE VI

Latex gloss enamel, presently commercially available from Red Devil under the description Interior Gloss Latex Enamel; it bears the commercial identification Hot Pink The pigment is 10.3% by weight of the enamel, and consists of titanium dioxide, fluorescent pink (sulfonamine-amidealdehyde resin containing less than 3% by weight of fluorescein). The vehicle constitutes 89.7% by weight of the enamel and is an acrylic emulsion of which the non-volatile phase is a vinyl acrylic resin, and the volatile phase is a mixture of water and propylene glycol.

EXAMPLE VII

Ink

| | % By Weight |
|---|---|
| Super IMPerse Jet Black [commercial aqueous carbon black dispersion sold by Hercules, Inc.] | 2–5 |
| Alkoxyacid sodium salt, sold by Universal Chemicals Corp. under the trademark Alkawet-B | 1 |
| Water | 94–97 |

EXAMPLE VIII

Ink

| | Grams |
|---|---|
| Dissolve together: | |
| deionized water | 100.0 |
| sodium hydroxide, crystal | 4.3 |
| to form liquid A | |
| Mix together: | |
| deionized water | 50.0 |
| aqueous dispersion of a thermoplastic material sold by the Dow Chemical Co. under the trademark Dow 22 Emulsion | 100.0 |
| to form liquid B | |
| Mill liquids A and B cold for 20 hours together with: | |
| carbon black sold by Cabot Corp. under the trademark Mogul L | 100.0 |
| sodium salt of a condensed mono-naphthalene sulfonic acid sold by Nopco Chemical Division of Diamond Shamrock Chemical Co. under the trademark Lomar PW | 27.0 |

EXAMPLE IX

Ink

| | Grams |
|---|---|
| Dissolved together: | |
| deionized water | 100.0 |
| sodium hydroxide, crystal | 4.3 |
| to form liquid A | |
| Mix together: | |
| deionized water | 50.0 |
| an aqueous dispersion of styrene-butadiene rubber sold by Goodyear under the trademark Pliolite LPR 4181 | 100.0 |
| to form liquid B | |
| Mill liquids A and B cold for 20 hours together with: | |
| carbon black sold by Columbia Carbon Co. under the trademark Raven 850 | 100.0 |
| sodium salt of a condensed mono-naphthalene sulfonic acid sold by Nopco Chemical Division of Diamond Shamrock Chemical Co. under the trademark Lomar PW | 27.0 |

EXAMPLES X–XIV

Liquid electrostatographic image developers

EXAMPLES I–V of U.S. Pat. No. 3,669,886 granted June 13, 1972.

EXAMPLES XV–XXV

Toners

EXAMPLES XX–XXX of U.S. Pat. No. 3,900,412 granted Aug. 19, 1975.

EXAMPLES XXVI–XXXVII

Toners

EXAMPLES XLI–LII of U.S. patent application Ser. No. 505,522, filed Sept. 12, 1974, for HYBRID LIQUID TONERS, by George E. Kosel, and assigned to the owner of the instant application, Philip A. Hunt Chemical Corp.

EXAMPLES XXXVIII–XLVIII

Inks

Water containing any one of the following dyes:

| EXAMPLE | NAME | COLOR INDEX NO. |
|---|---|---|
| XXXVIII | Crystal Violet | 42,555 |
| XXIX | Malachite Green | 42,000 |
| XL | Methylene Blue | 52,015 |
| XLI | Victoria Blue | 42,595 and 44,045 |
| XLII | Carmine Red | 75,470 |
| XLIII | Nigrosine C 140 powder | 50,420 |
| XLIV | Chloramine Black Ex (dark) | 30,235 |
| XLV | Rayon Black C (double conc.) | 35,255 |
| XLVI | Chris Cuprofles 3 LB | Direct Black 63 |
| XLVII | Alizarine Light Green GSN | 25 |
| XLVIII | Lanasyn Brilliant Blue GL | Similar to C.I. Acid Blue 127 |

The foregoing dyes are present in the water in an amount of from about 0.1% to about 10% by weight.

EXAMPLES XLIX–LV

Inks

Water containing any one of the following pigments:

| EXAMPLE | NAME |
|---|---|
| XLIX | Ultramarine Blue |
| L | Cadmium Sulfite |
| LI | Titanium Dioxide |
| LII | Zinc Oxide |
| LIII | Iron Oxide |
| LIV | Aluminum powder |
| LV | Bronze powder |

The foregoing pigments are present in the water in an amount of from about 0.1% to about 30% by weight, and there preferably is additionally present a suspending agent such as copoly(vinyl acetate/vinyl laurate) (80/20) or copoly(vinyl acetate/vinyl stearate) (85/15) in an amount of about 3% to about 10% by weight.

If desired, there may be added to any of the liquid developers adjuvants of well known types having conventional functions such, for instance, as adjuvants which increase surface tension, adjuvants which decrease surface tension, adjuvants which delay drying, adjuvants which speed up drying, adjuvants providing a binding function, and adjuvants which act as filming agents.

From the foregoing, it should be apparent that the particular type or formulation of a liquid developer is not critical to the operation of this invention, providing that its viscosity, surface tension and density are within the ranges set forth herein.

The sequence of events that takes place at the development station and which results in the development of the latent electrostatic image best can be understood in the simplest form of the invention by reference to FIGS. 2–9 and, thereafter, by reference to FIGS. 10–16.

In FIG. 2 the developer roller 40, the film 42 of liquid developer and the photoconductor 44 have been illustrated at the moment that a latent electrostatic charged segment 50 on the photoconductor surface is nearing but still is relatively remote from the development zone Z at the gap 46. In this figure only a single charged segment has been illustrated, the same being denoted by two negative charges that conjointly constitute the segment in question. In this figure no externally applied electrostatic field is indicated as being derived from the source of voltage shown in FIG. 1. For the purpose of the initial description, such voltage will not be discussed with respect to FIGS. 2–9 but will be discussed subsequently. It will be recalled that the present invention will function satisfactorily in the absence of a voltage which merely augments the transference, now to be described, of the liquid developer in a selective manner from the film 42 to the photoconductor 44 at the electrostatically charged segments (in the discussion of FIGS. 2–9, only the single electrostatically charged segment 50).

While the segment 50 still is relatively remotely spaced from the development zone Z but at a certain point of its approach, as illustrated schematically, for example, in FIG. 2, the electrostatic charge at the segment 50 creates an electrostatic field between this segment and the opposed portion of the liquid film 42. The electrostatic field still is relatively weak, compared to the field at the development zone, because the segment 50 and the opposed portion of the film still are approaching each other and have not yet reached their zone of closest proximity. At this time, the electrostatic field will raise a slight bulge 52 in the film 42 in the portion of the film opposed to the segment 50. The radial height of the bulge 52 and the distance of said bulge from said segment 50 to the development zone Z are shown schematically, and any measurements taken from this figure are not to be considered as a limitation upon the invention.

FIG. 3 illustrates the relative positions of the developer roller 40, the film 42, the photoconductor 44 and the segment 50 at a slightly later point in time at which the segment 50 has approached more closely to the development zone Z than in FIG. 2. Because of the reduction of the space between the segment and the opposed portion of the film at this relative position of the various components, the electrostatic field is stronger so that the bulge 52 has increased in radial height and has somewhat enlarged its base, being now more accurately described as a dome 54.

FIG. 4 illustrates the next alteration in the shape of the bulge/dome, it being again observed that the assumption of the particular shape now to be described for the altered dome which is denoted by the reference numeral 56 is schematic as to the distance between this altered dome 56 and the zone Z. Phrased differently, the progressive changes in the shape of the portion of the film opposed to the segment 50 as the segment and said opposed portion of the film move toward the zone Z is substantially correctly illustrated in the figures as to the changing shape of the bulge/dome, but the precise positions at which the successive changes in shape take place will vary with the actual spacing between the platen and the roller, with the type of photoconductor, with the magnitude of the charge of the latent electrostatic image, and with the specific liquid developer employed. In any event, in FIG. 4 there will be seen a new configuration that is assumed by the dome 56. This configuration constitutes the initiation of a raised peak 58 at approximately the circumferential center of the dome. The peak is, as yet, not pronounced.

As the segment 50 moves closer to the zone Z (see FIG. 5) the peak 58 becomes better defined and increases in height as indicated by the reference numeral 60. The change from the height of the peak 58 to the height of the peak 60 actually takes place quite rapidly and is in the nature of the initiation of a spurt or jet of liquid from the altered dome 56 toward the segment 50.

The speed at which the jet or spurt is ejected from the altered dome 56 accelerates as the segment 50 moves closer to the zone Z, this being illustrated in FIG. 6 where the peak 62, now properly to be called a spike or pseudopod, extends quite far from the dome 56 toward the segment 50. There is a tendency, at the same time, for the volume of the altered dome to be somewhat reduced as more liquid flows from said dome into the pseudopod, the speed of the upwardly jetting liquid in the pseudopod tending to increase as the tip 64 of the pseudopod approaches the segment 50. The pseudopod also becomes quite slender.

Figure 7:
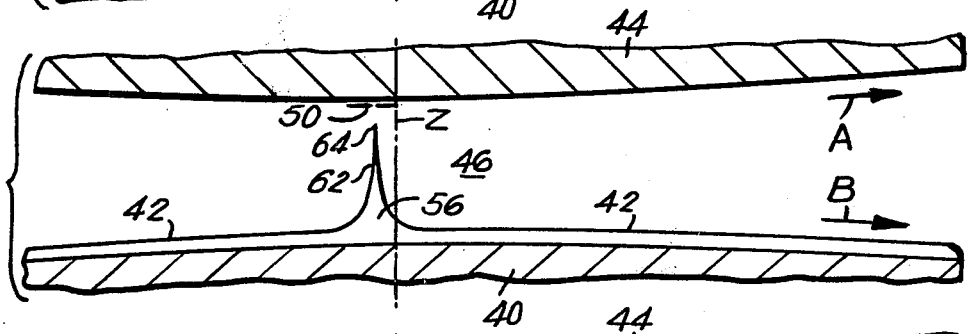

As the platen and developer roller continue to turn and the segment 50 almost reaches the zone Z, as illustrated in FIG. 7, the pseudopod 62 is further elongated and its tip 64 approaches very closely to the segment 50, said segment and said pseudopod at this moment being almost but not yet quite at the zone Z. At this time, the pseudopod still is jetting upwardly.

Attention is called to the fact that all of the changes in shape of the portion of the liquid film opposing the segment 50, which changes constitute progressive raising of the liquid, first as a bulge and dome and then as an upwardly jetting pseudopod at about the center of an altered dome, are motions of the liquid in the film against the force of gravity.

Figure 8:
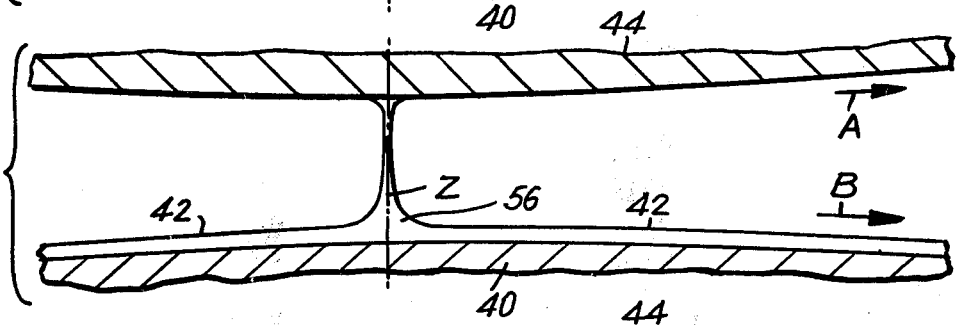
Figure 9:
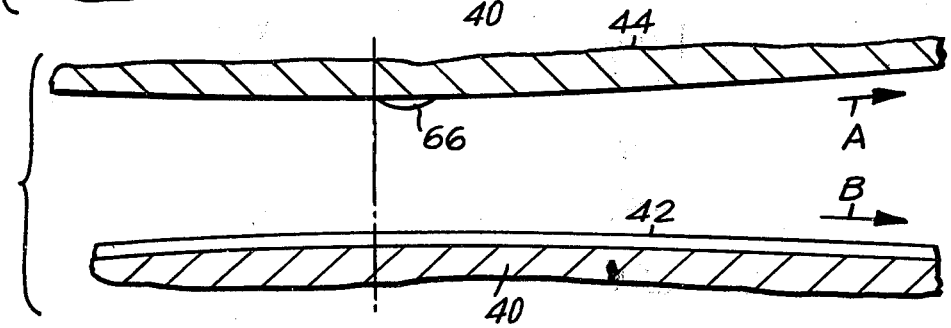

Finally, the segment 50 reaches the zone Z (see FIG. 8) at which time the tip of the pseudopod touches the photoconductor 44 at the segment. The moment the tip of the pseudopod touches the photoconductor, three things happen. First, the charge of the segment 50 is discharged through the pseudopod and the electrostatic field created by said segment collapses. Second, the liquid at the tip of the pseudopod spreads out along the surface of the photoconductor at the segment. The spread is not appreciable despite the fact that the photoconductor surface shown in FIG. 8 is wettable by the liquid. Third, liquid is drawn up from the pseudopod onto the surface of the photoconductor by virtue of surface tension and, at the same time, the pseudopod at the region slightly below the surface of the photoconductor thins to the point (not shown) that the pseudopod snaps and the liquid in the pseudopod and dome falls back into and reconstitutes the quiescent state of the film 42 as illustrated in FIG. 9.

A droplet 66 remains on the photoconductor surface. This droplet, because the photoconductor at the charged segment is wettable by the liquid developer (e.g. the photoconductor is zinc oxide in polyvinyl acetate on a paper backing and the liquid developer is an aqueous developer), tends to spread out. It is extremely difficult, owing to the restricted space in which it resides and to its fleeting nature, to measure the size of a droplet; however, it is thought that the size of a droplet ranges from about 0.5 to 50 mils in breadth and, of course, will depend amount other things, on the size of the segment 50.

It is appropriate, here, to consider FIG. 16 which illustrates an alternate method of transfer of a droplet of liquid developer from the film 42 to the photoconductor 44 at the segment 50. In this figure a position has been shown in the segment which corresponds to the position of FIG. 8, i.e. when the segment 50 has reached the point of closest proximity, i.e. the zone Z, and the tip of the pseudopod 62 has approached but not quite reached the photoconductor 44. In the step illustrated in FIG. 16 the spacing at the gap 46 is sufficiently large for the jetting pseudopod 62 not to touch its tip to the photoconductor 44 at the segment 50 but, rather, under the influence of the local electrostatic field, for the tip of said pseudopod to become detached from the pseudopod and move under the influence of said local electrostatic field to the photoconductor at the segment 50. In FIG. 16 the detached tip is shown in the form of a droplet 68 moving rapidly to said segment 50. As in the case of the pseudopod, the tip of which eventually touches the photoconductor, the separation of a droplet from the tip of the pseudopod, as illustrated in FIG. 16, and its flight toward the photoconductor are opposed by the force of gravity which, however, as in the case of the tip of the pseudopod touching the photoconductor directly, is overcome by the local electrostatic field.

A theory of the pseudopod and droplet formation under the influence of an electrostatic field which was developed in connection with the action of water drops in strong electric fields in thunderstorms is discussed in the article entitled "Disintegration of Water Drops in an Electric Field" by Sir Geoffrey Taylor, F.R.S., at pages 383–397 of *Proc. Roy. Soc. A,* Volume 280 (1964).

Equally important to an understanding of the present invention is the behavior of pseudopods, and detached droplets if the same are present where there is no electrostatically charged segment on the photoconductor, that is to say, where a background exists which is not to have a droplet or droplets of the liquid developer deposited thereon by transference from the film 42.

When there is a large number of charged segments, bulges, domes and pseudopods upon occasion will be formed in portions of the film opposed to the uncharged segments of the photoconductor as well as the charged segments. These raisings of the film are believed to be due to the interplay between closely adjacent electrostatic fields or to external influences. Even if undesired pseudopods are raised where there is no opposed charged segments, and even if a droplet should detach from the tip of an undesired pseudopod, there will be no deposit of the liquid developer on an uncharged segment because of the counteracting force of gravity on such pseudopods or droplets where there is no charged segment to fully overcome the gravitational force. It has been found that where the various parameters mentioned above for the apparatus and the liquid toner are followed, and principally where the minimum spacing between the surface of the film and the surface of the photoconductor at the development zone is not less than 4.5 mils, the gravitational forces prevent the liquid developer from reaching the photoconductor even if undesired pseudopods or droplets are created. The speed at which the jet is engendered, the height to which the jet extends, and the velocity of a droplet, if formed, are not sufficient to overcome the force of gravity to an extent such as to permit any liquid developer to reach any uncharged segments, so that the background of the photoconductor, where there are uncharged segments, remains in its virgin state whereby high contrast, good line definition and clarity of image are insured. When the spacing aforesaid becomes less than 4.5 mils, the pseudopods and/or droplets cannot invariably be prevented from reaching background uncharged segments.

Figure 10:
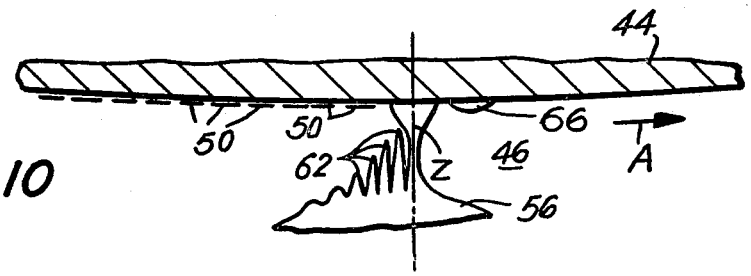
FIG. 10 is a view similar to FIG. 8, but illustrating plural, closely spaced charged areas of an electrostatic latent image on the photoconductor surface.

FIG. 10 illustrates in a schematic fashion the configuration of the developer film at the development zone when there is a large number of closely spaced segments 50 as, for example, where there is a solid area of image which is to be developed. In this case, the altered dome 56 has a large number of spikes, i.e. pseudopods 62, formed therein, the same progressively increasing in height as the development zone is approached until at the development zone spike after spike touches the photoconductor 44 to deposit droplets 66 thereon which, if sufficiently close to one another, will merge. Depending on the spacing at the zone, i.e. if the spacing is sufficiently large, a series of droplets may be formed, one for each of the spikes or jets, which will fly to the photoconductor 44.

Although mention has been made of the fact that the droplets tend to become detached from the tips of the spikes as the gap 46 increases, rather than having the tips of the spikes touch the photoconductor, the distance alone does not control the formation or absence of the droplets which also depends upon other factors such as the speed of movement of the developer roller and photoconductor, and the viscosity, the density and the surface tension of the developer liquid. Both modes of development at the development zone, these being the touching of the tips of the spikes and the detachment of droplets which fly to the photoconductor, are indistinguishable variations in the practice of this invention.

In FIG. 11 a schematic typical configuration of the film 42 is illustrated for a few widely spaced segments 50. It will be observed that the sundry domes 54 tend to blend into one another and that the bulges and spikes are formed as the domes approach the development zone Z.

FIG. 1 indicates the presence of an external electrostatic field applied to the development zone Z by a potential applied between the platen 22 and the developer roller 40 via slip rings, both the platen and the developer roller being conductive. The externally applied field preferably has a direction the same as that created by the electrostatic charge of the segments 50 to supply an additional electrostatic field between the developer roller and the photoconductor and preferably one which augments the electrostatic field created by the segments 50 although it may oppose the same if desired. It will be understood that even with this modified electrostatic field the balance of forces on the pseudopods, i.e. jets or spikes, and/or on droplets detached from the tips of spikes is such that the tips of spikes or the droplets never reach an uncharged segment, i.e. a background uncharged segment.

Typical voltages for creating an external electrostatic field range from $-1{,}000$ volts to $+1{,}000$ volts, preferred values being less than 200 volts, and the voltage usually being a function of the spacing, with smaller voltages being used for smaller spacings and larger voltages being used for larger spacings. For example, at 7 mils spacing an excellent voltage is 100 volts, at 15 mils a good voltage is 300 volts, and at 40 mils a suitable voltage is 1,000 volts.

It is within the scope of the invention, although not preferred, for the polarity of the applied voltage to be the same as the polarity of the electrostatically charged segments 50 and, in these cases, the applied voltage preferably is lower than the electrostatic charge voltage of said segments.

The voltage creates an electrostatic field between the developer roller and the photoconductor. The maximum field at a spacing of 4.5 mils is about $1\times10^5$ volts/cm. which is an applied voltage of about 1,000 volts, and for a 40 mil spacing is about $4\times10^4$ volts/cm. which is an applied voltage of about 4,000 volts.

FIG. 12 has been included simply to show a dome 54 with an associated spike 62 in the background and another dome and spike in the foreground, the latter spike being at the development zone Z and the former dome and spike still not having reached the development zone.

FIG. 13 has been included to illustrate the appearance of a dome 54 having a pair of spikes 62 jetting therefrom toward a pair of closely spaced charged segments 50, indicating that, where the segments are spaced closely enough together, but a single dome 54 may be formed from which commonly the pair of spikes jet upwardly.

FIG. 14 is similar to FIG. 8, the difference being that the photoconductor 44 is not wettable by the liquid of the film 42, so that the tip of the spike (pseudopod) 62 as it impinges on the photoconductor tends to form a convex meniscus 70, and the droplet 72 left upon collapse of the dome and spike likewise has a convex meniscus where it encounters the photoconductor (see FIG. 15).

The function of the present invention depends upon the presence at the development zone of a pool of liquid developer from which a pseudopod, i.e. spike or jet, can be raised to strike the opposed spaced photoconductor at a charged segment or have its tip detach to form a droplet which strikes the opposed spaced photoconductor at a charged segment. One method of providing such a pool has been described with respect to all the previously discussed figures, to wit, by creating a film of liquid developer on a rotating horizontal roller at the development zone. There are, however, acceptable alternates to this arrangement, one of which is shown in FIG. 17.

Basically, the pool is provided, as shown in this figure, by a capillary passageway or passageways which extend from a body of liquid developer at the lower end of the passageway to a pool at the upper end of the passageway, the pool being located at the development zone. The capillary passageway or passageways can be created in various fashions. For example, a sieve or perforated plate with vertical perforations may be located in the vicinity of the development zone with the bottom of the sieve or plate in contact with a body of liquid beneath it and with the openings in the sieve or plate of capillary dimensions of sufficient size to permit the liquid to raise in the capillary passageway or passageways to the top or tops thereof from which liquid can be drawn upon the approach of a charged segment 50 to pull up a spike, i.e. jet or pseudopod, with the results described heretofore.

More particularly, in FIG. 17 the reference numeral 74 denotes a body of developing liquid at the development zone and spaced below the photoconductor. Disposed in said body is a pair of parallel vertical plates 76, 78 spaced apart to define a vertical passageway 80 of capillary width up which a capillary sheet 82 of developing liquid rises by virtue of capillary action. As charged segments pass over the upper ends of the plates and spaced therefrom by the gap spacing above described, i.e. at least 4.5 mils, bulges and domes 84 will be raised from the upper end of the capillary sheet 82 from which jets, i.e. pseudopods of spikes, will spurt upwardly in the manner already described to develop charged image segments. In the operation of a developing mechanism as shown in FIG. 17, the preliminary low bulges will not be raised nor are they necessary since, as the charged segments reach a region above the upper ends of the capillary sheet 82, the electrostatic field immediately will raise the liquid into spikes, i.e. jets or pseudopods.

FIG. 18 illustrates an apparatus 86 embodying a modified form of the invention which essentially is the same apparatus as shown in FIG. 1, the supply and take-up rolls and charging and exposure and drier stations being omitted for the sake of simplicity. The sole difference between the apparatus 20 of FIG. 1 and the apparatus 86 of FIG. 18 is in the location of the development station 32. It will be recalled that in FIG. 1 the developer roller 40 is directly below the lowest point on the platen 22. In the apparatus 86 the developer roller 40 is angularly spaced from a position directly below the lowermost point of the platen, so that the radial gap between the developer roller and the web 24 is at an angle to the vertical. However, this angle still includes a vector component extending radially downwardly from the web to the developer roller so that the force of gravity tends to prevent the tip of a spike or detached droplet from reaching the photoconductor coating on the web 24 where there is no charged segment.

The drier 33 can be of any conventional construction compatible with the developer liquid and the image carrier. A typical drier is a source of heat.

In the equipment just described, the image which has been toned pursuant to the present invention is rendered permanent by drying the same on the substrate that was toned in the first instance. However, as noted previously, the toned image can be transferred to some other substrate and there rendered permanent, e.g. by heating or by drying followed by pressure fixing. The particular manner in which the toned image is employed is not a part of the present invention. Various uses can be made of the toned image. Thus, it can be employed, after being rendered permanent, as a substrate, such as a sheet on which information is contained, for instance, on newspaper or office copies or computer printouts, or it can be used as a lithographic master, such utilizations of a toned image being well known in the art and described, for example, in U.S. Pat. No. 3,990,980. Moreover, a lithographic master can be prepared by transferring the toned image to a substrate where it acts to retain an inked image without the necessity of the swabbing technique mentioned in the aforesaid U.S.L.P.

Once again, it should be emphasized that the mode of creating the charge image and the mode of using the toned image have no bearing upon the present invention which is wholly concerned with the novel manner herein disclosed of toning a charge image.

The present invention is capable of many commercial applications; the application described in the preceding portion of the specification are for the reproduction on sheets of graphic material such, for instance, as letters, books, drawings, prints, etc. which are in the domain of conventional office reproduction machines. However, the instant invention can be used for a wide variety of other purposes for which electrostatic reproduction can be employed. By way of example, such applications include the following end products and uses: lithographic printing plates on such sundry substrates as paper and metal; offset lithographic plates; decorative panels constituting rigid and flexible substrates such as metal, wood and fabric; name plates, if the name plates are conductive, e.g. metal, the toned image is prepared on a suitable substrate in accordance with the present invention and thereafter is transferred to the metal substrate as indeed the case for all end products on which the image cannot be electrostatically formed directly; the imaging of printed circuitboards wherein the toned image ultimately deposited on a conductive substrate can be used either as a plating resist or as an etch resist; the conformal overcoating of integrated circuits and circuitboards with a protective insulating layer which effectively encapsulates the same; printing on plastic foils as in flexographic printing; all types of transfer printing onto rigid or flexible paper or aluminum or plastic films; all types of direct imaging on rigid or flexible substrates; the incorporation of sublimable ingredients in the toner and the toned image which ingredients will enable sublimable transfer of materials such as dyes from an image to a receiving substrate; electrostatic printing of labels; deposition of organic catalysts from toners for use as sites for electroless deposition of cooper; inclusion in the toner of nuclei for use with Itek's RS process; and forming resists for use in the preparation of rotogravure of letterpress plates and cylinders.

It thus will be seen that there are provided methods which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having this described the invention, there is claimed as new and desired to be secured by Letters Patent:

1. A method for developing a latent electrostatically charged image on a member by passing the image-bearing member above and close to but out of contact with a surface of a liquid developer in the form of a continuous film at a development zone, the surface of the liquid developer at the development zone being spaced from the image-bearing member at the development zone, said film having a smooth surface prior to its approach to the development zone, the space between the latent image on the image-bearing member and the surface of the liquid developer at the development zone being between 4.5 and 40 mils, the liquid developer having a viscosity of 0.5 to 50 centipoises, a surface tension of 20 to 75 dynes/cm, and a density in order of 1 gram/cc, and the latent electrostatic image having a surface potential of at least 100 volts, portions of the surface of the liquid developer at the development zone opposed to charged segments of the image jetting toward the segments under the influence of the charges on the segments as pseudopods perpendicular to the film and to the image-bearing member, the liquid at the tips of such pseudopods reaching the charged segments, while liquid in any pseudopods formed in opposition to uncharged segments at the development zone is prevented from reaching the uncharged segments by the force of gravity.

2. A method as set forth in claim 1 wherein the latent image and the surface of the liquid developer approach each other toward the development zone and then recede from each other.

3. A method as set forth in claim 1 wherein an external electrostatic field is applied across the development zone.

4. A method as set forth in claim 3 wherein the external field is in the same direction as that created by the latent image.

5. A method as set forth in claim 4 wherein a potential is applied across the space at the development zone in the range of from $-1{,}000$ volts to $+1{,}000$ volts to create the external field.

6. A method as set forth in claim 5 wherein the potential is in the range of from 100 to 300 volts.

7. A method as set forth in claim 1 wherein there is no externally applied field.

8. A method as set forth in claim 1 wherein the relative speeds of movement of the latent electrostatic image and of the surface of the liquid developer at the development zone are in the range of form 0 to 20 feet per minute.

9. A method as set forth in claim 8 wherein the speed of movement of the latent electrostatic image at the development zone is about 1 foot per minute faster than the speed of movement of the developer liquid at said zone.

10. A method as set forth in claim 8 wherein the speed of movement of the latent electrostatic image at the development zone is in the range of from 20 feet per minute to 150 feet per minute.

11. A method as set forth in claim 1 wherein liquid developer is brought to the development zone by a roller as a film on the cylindrical surface thereof.

12. A method as set forth in claim 11 wherein the thickness of the film of liquid developer on the roller is in the range from ½ mil to 10 mils.

13. A method as set forth in claim 11 wherein the thickness of the film of liquid developer on the roller is about 1.5 mils.

14. A method as set forth in claim 1 wherein the space between the latent image and the surface of the liquid developer at the development zone is about 7.5 mils.

15. A method as set forth in claim 1 wherein the space between the latent image and the surface of the liquid developer at the development zone is not more than 20 mils.

16. A method as set forth in claim 1 wherein the latent electrostatic image is carried by a film of a substance selected from the group consisting of zinc oxide and a resin carrier, selenium, polyvinyl carbazole, cadmium sulfide, and a dielectric material.

17. A method as set forth in claim 1 wherein the latent electrostatic image is carried by a sheet which passes under and in contact with a platen.

18. A method as set forth in claim 17 wherein the platen is arcuate.

19. A method as set forth in claim 17 wherein the platen is stationary.

20. A method as set forth in claim 17 wherein the platen is a rotating cylinder.

21. A method as set forth in claim 1 wherein the latent electrostatic image is supported at the development zone by a rotary platen and the liquid developer is brought to the development zone by a rotating developer roller, the axes of rotation of the platen and of the roller being horizontal and parallel, and the axis of rotation of the platen being substantially vertically above the axis of rotation of the developer roller.

22. A method as set forth in claim 1 wherein the latent electrostatic image is supported at the development zone by a rotary platen and the liquid developer is brought to the development zone by a rotating developer roller, and the axis of rotation of the developer roller being angularly displaced from a position vertically below the axis of rotation of the platen.

23. A method as set forth in claim 1 wherein the liquid from the tips of the pseudopods reach the member as droplets the sizes of which range from 0.5 to 50 mils.

24. A method as set forth in claim 1 wherein the tips of the pseudopods touch segments of the image at the development zone and subsequently droplets break away from the tips and remain at the sites of the segments.

25. A method as set forth in claim 1 wherein as the pseudopods reach the development zone the tips thereof opposed to segments of the image become detached from the pseudopods to form droplets which travel to the segments of the image and remain at the sites of the segments.

26. A method as set forth in claim 1 wherein a body of liquid developer is provided which is raised toward the development zone by capillary action but remains out of contact with latent electrostatic images at said zone except for the jetting of the pseudopods.

27. A method as set forth in claim 1 wherein the liquid developer is an aqueous liquid.

28. A method as set forth in claim 27 wherein the liquid developer also includes a coloring agent.

29. A method as set forth in claim 28 wherein the coloring agent is a dye.

30. A method as set forth in claim 28 wherein the coloring agent is a pigment.

31. A method as set forth in claim 1 wherein the liquid developer is an organic liquid.

32. A method as set forth in claim 31 wherein the liquid developer also includes a coloring agent.

33. A method as set forth in claim 32 wherein the coloring agent is a dye.

34. A method as set forth in claim 32 wherein the coloring agent is a pigment.

* * * * *

UNITED STATES PATENT AND TRADEMARK OFFICE

CERTIFICATE OF CORRECTION

PATENT NO. : 4,202,913

DATED : May 13, 1980

INVENTOR(S) : Irving L. Klavan, et al.

It is certified that error appears in the above-identified patent and that said Letters Patent are hereby corrected as shown below:

On The Title Page:

[22] Filed: June 29, 1978

Signed and Sealed this

*Twenty-fourth* Day of *June 1980*

[SEAL]

*Attest:*

SIDNEY A. DIAMOND

*Attesting Officer*

*Commissioner of Patents and Trademark*